United States Patent [19]

Reid

[11] Patent Number: 4,968,184

[45] Date of Patent: Nov. 6, 1990

[54] GROUT PACKER

[75] Inventor: Leslie C. Reid, Duncan, Okla.

[73] Assignee: Halliburton Company, Duncan, Okla.

[21] Appl. No.: 370,671

[22] Filed: Jun. 23, 1989

[51] Int. Cl.[5] ..... E02B 17/02; E02D 5/52

[52] U.S. Cl. ..... 405/225; 405/195; 405/227

[58] Field of Search ..... 405/225, 224, 227, 226; 152/428, 429, 511, 512, 430, DIG. 13, DIG. 7

[56] References Cited

U.S. PATENT DOCUMENTS

| | | | |
|---|---|---|---|
| 2,435,466 | 2/1948 | Thomas | 152/428 X |
| 2,495,955 | 1/1950 | Bourdon | 152/429 |
| 2,500,531 | 3/1950 | Eger | 152/429 |
| 3,468,132 | 9/1969 | Harris . | |
| 3,533,241 | 10/1970 | Bowerman et al. | 405/225 |
| 3,570,259 | 3/1971 | Thaxton . | |
| 3,635,275 | 1/1972 | Davis et al. | 152/429 |
| 3,702,537 | 11/1972 | Landers . | |
| 3,919,850 | 11/1975 | Coone et al. . | |
| 3,967,456 | 7/1976 | Stone . | |
| 4,041,718 | 8/1977 | Stone . | |
| 4,047,391 | 9/1977 | Mayfield et al. | 405/225 |
| 4,052,861 | 10/1977 | Malone et al. . | |
| 4,063,427 | 12/1977 | Hoffman . | |
| 4,140,426 | 2/1979 | Knox | 405/225 |
| 4,171,923 | 10/1979 | Landers | 405/225 |
| 4,181,454 | 1/1980 | Knox et al. | 405/227 |
| 4,220,422 | 9/1980 | Sullaway | 405/225 |
| 4,337,010 | 6/1982 | Sullaway et al. | 405/227 |
| 4,772,158 | 9/1988 | Coone | 405/227 |

OTHER PUBLICATIONS

Exhibit A—Promotional Brochure of Halliburton Services.

Exhibit B—Promotional Brochure of Oil States Industries Division of LTV Energy Products of Arlington, Tex.

*Primary Examiner*—Dennis L. Taylor

*Attorney, Agent, or Firm*—James R. Duzan; L. Wayne Beavers

[57] ABSTRACT

An inflatable grout packer includes a housing having an inner bore. An annular inflatable bladder is received in the inner bore of the housing. The bladder has an inflation cavity defined therein for containing an inflatation fluid. The bladder has first and second axial ends and has radially inner and outer walls. The bladder provides a seal between the housing and an elongated cylindrical member, typically a piling, received through the bladder. First and second end rings are sealingly bonded to the first and second ends of the bladder and also sealingly attach to the housing so that a backup seal is thereby provided against leakage of inflation fluid through the radially outer wall of the bladder. An inflation coupling is attached to the radially outer wall.

20 Claims, 5 Drawing Sheets

GROUT PACKER

BACKGROUND OF THE INVENTION

1. Field of the Invention

This invention relates to an inflatable seal for sealing the annulus between an outer hollow member and an inner member contained therein, and more particularly, but not by way of limitation, relates to an inflatable grouting seal to support a column of grout while the grout is setting in the annulus between the jacket leg of an offshore platform and a pile driven therethrough.

2. Description of the Prior Art

Offshore platforms are usually fabricated either in a harbor or at an onshore location, and are subsequently transported on barges or towed horizontally through the water to a marine site where they are uprighted and lowered so that the legs of the platforms rest on the ocean floor. The offshore platform legs are hollow structures having pilings driven downwardly therethrough into subterranean formations below the ocean floor to anchor the platform in position. These pilings are typically welded to the jacket legs of the platform near the top of the platform. Additionally, in many instances it is desirable to fill the annulus between the jacket leg and the piling with grouting material so that a unitary load-bearing structure is created. To facilitate the grouting of the annulus between the jacket leg and the piling a grout seal or grout packer is frequently utilized.

A typical prior art packer which has been utilized by the assignee of the present invention is that shown in U.S. Pat. No. 4,337,010 to Sullaway et al. The Sullaway packer has an inflatable packer element which is bonded to end rings which are in turn sealingly welded to the inner bore of a housing member. As seen in FIG. 3 of Sullaway, the packer is inflated by pumping pressurized fluid into the space between the inner bore of the housing and the outer surface of the packer element. The Sullaway packer relies upon the weld seal between the end rings and the housing to contain this pressurized fluid. In order to test the packer of Sullaway, prior to actual use on an offshore platform, it is necessary for the inflatable packer element and its end rings to be installed in its housing and welded in place. Subsequently the entire housing must be welded in place as a portion of the jacket leg of an offshore platform. This is an inconvenience in that many customers prefer to provide their own outer housing element and to utilize a packer which can be tested prior to being installed in the housing element.

Another design of grout packer which is in common usage is that shown in U.S. Pat. No. 3,468,132 to Harris. The Harris packer utilizes an inflatable bladder having radially inner and outer walls with an inflation cavity defined therebetween. The inflation fluid is pumped into the inflation cavity to expand the bladder. The axial ends of the bladder are mechanically but not sealingly connected to end rings which are received within the outer housing. If the bladder of Harris leaks, the packer will fail.

SUMMARY OF THE INVENTION

The present invention provides an improved grout packer which utilizes an inflatable bladder type packing element, and which also provides a backup seal in the event the outer wall of the bladder element leaks. Additionally, the present invention provides improvements in the design of inflatable bladder elements themselves.

The inflatable packer apparatus of the present invention includes a housing having an inner bore. An inflatable bladder means is received in the inner bore of the housing. The bladder means has an inflation cavity defined therein for containing an inflation fluid. The bladder means has first and second axial ends and has radially inner and outer walls. The bladder provides a means for sealing between the housing and an elongated cylindrical member, typically a piling, received through the bladder.

First and second end rings are sealingly bonded to the first and second ends of the bladder. The end rings are also sealingly attached to the housing so that a backup seal is thereby provided against leakage of inflation fluid through the radially outer wall of the bladder means.

An inflation coupling is attached to the radially outer wall of the bladder and has an inflation inlet defined therethrough. The housing has a transverse access opening defined therethrough and aligned with the inflation inlet. An inflation nipple is sealingly engaged with the bore of the inflation coupling and extends outward through the access housing. A filler sleeve is received about the inflation nipple within the access opening of the housing and is sealingly welded to the housing and the inflation nipple.

The inflation coupling includes a cylindrical coupling body having a bore defined therethrough and having an annular flange extending outward from the body. The body has a threaded outer cylindrical surface. A threaded nut is engaged with the outer surface of the coupling body. A reinforcing fabric has an opening therein through which the coupling body is received. The reinforcing fabric is sandwiched between the flange and the nut and is imbedded in the radially outer wall of the bladder means.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENT

Figure 1:
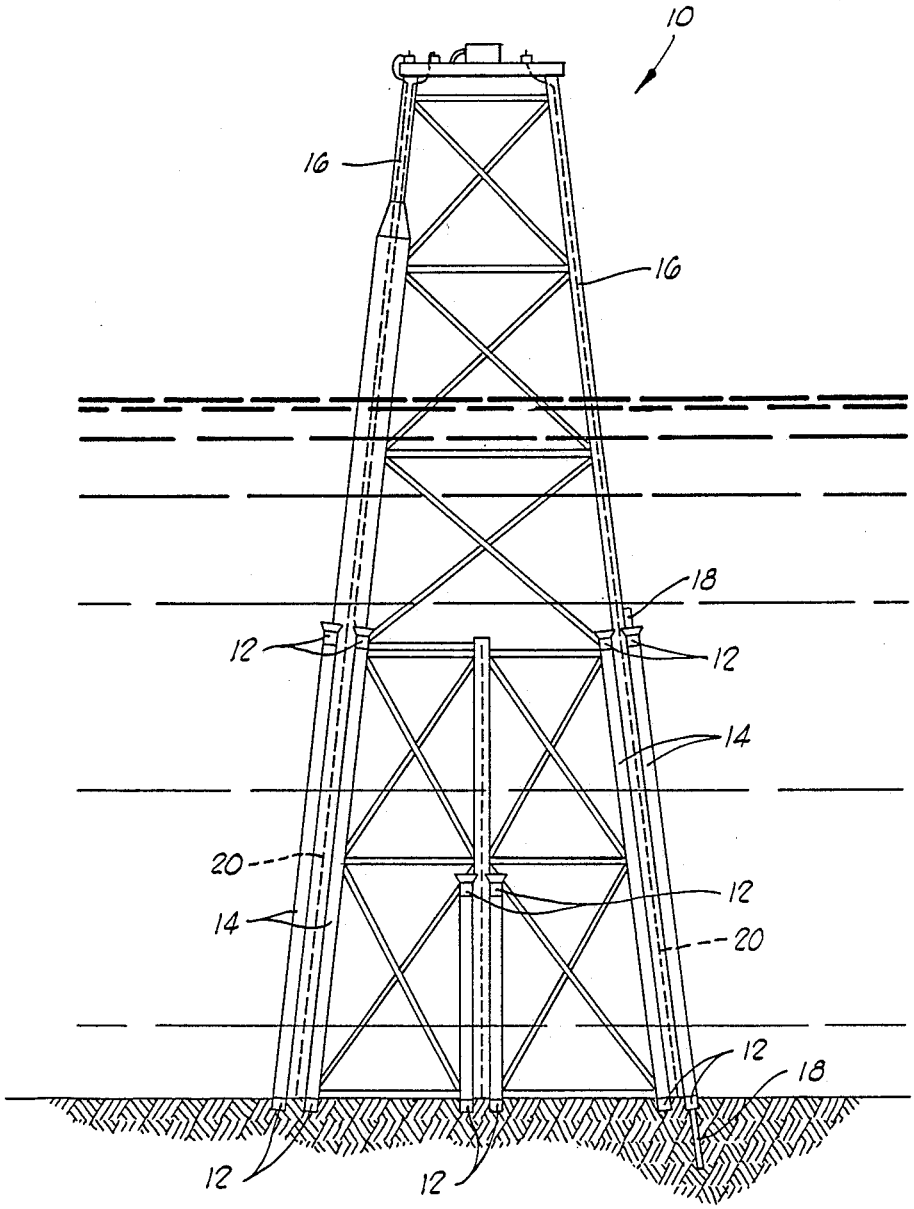
FIG. 1 is a schematic elevation view of an offshore platform.

Referring to FIG. 1, an offshore platform 10 is shown having inflatable packers 12 of the present invention installed in the bottom and top of pile sleeves 14 of jacket leg 16 and intermediate the jacket leg 16. A pile 18 is shown as being driven to a depth through one pile sleeve 14 and being terminated above the upper inflatable packer 12 installed on that pile sleeve 14. Although shown installed on the pile sleeves 14, the inflatable packers 12 may be installed directly on the jacket legs 16. An inflation line 20 runs to the inflatable packers 12. As will be understood by those skilled in the art, grout lines (not shown) and grout return lines (not shown) will also be associated with the pile sleeves 14 for directing grout to the interior thereof. Those grout lines and grout return lines are not shown in FIG. 1 for the purpose of clarity.

Figure 2:
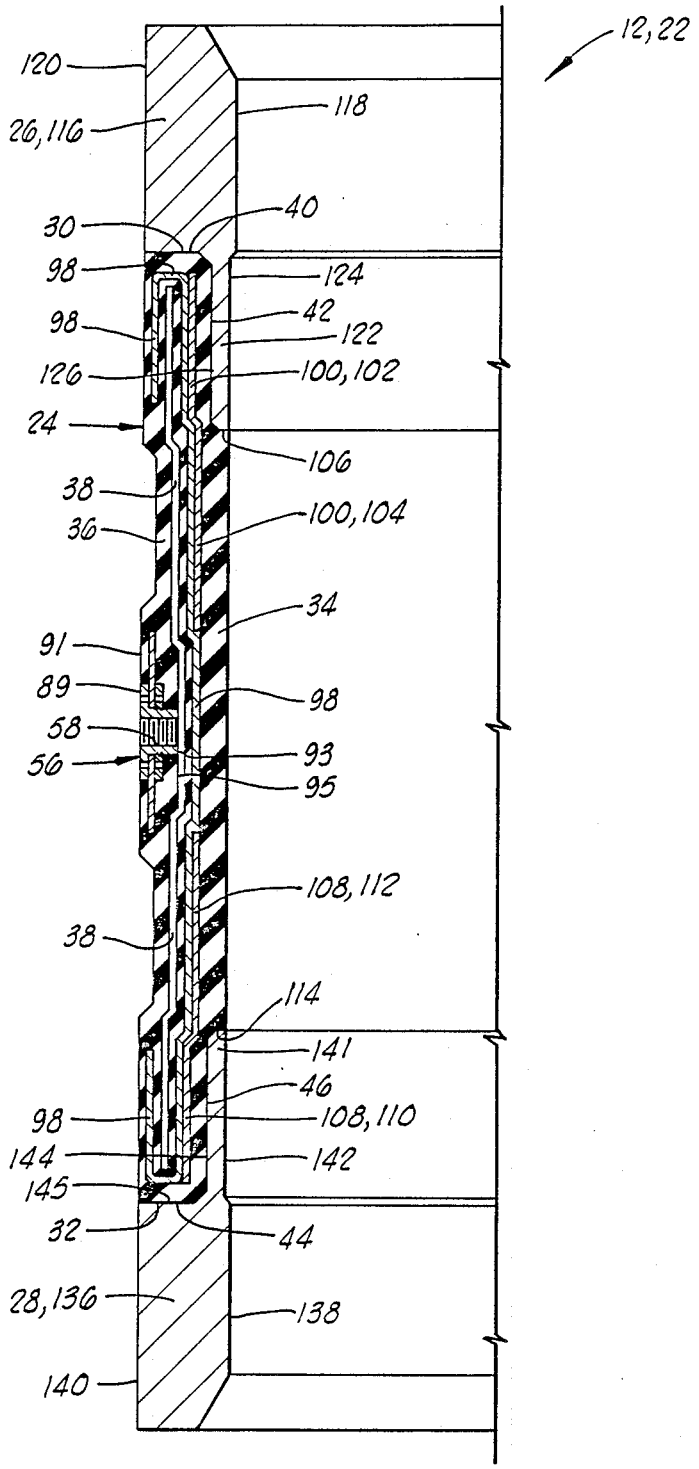
FIG. 2 is an elevation sectioned view of a first embodiment of an inflatable bladder assembly of a grout packer. The assembly of FIG. 2 has not yet been installed in an outer housing, and is shown in an uninflated position.

Turning now to FIG. 2, an inflatable bladder assembly 22 of the packer 12 is thereshown. The inflatable bladder assembly 22 includes an inflatable bladder means generally designated by the numeral 24, and first and second axial end rings 26 and 28.

The inflatable bladder means 24 is annular in plan, and has first and second axial ends 30 and 32, and radially inner and outer walls 34 and 36. An inflation cavity 38 is defined between the radially inner and outer walls 34 and 36 for containing an inflation fluid which may be either a gas or a liquid. Bladder means 24 is typically molded from an elastomeric material such as rubber.

The first end ring 26 is sealingly bonded to the first end 30 of inflatable bladder means 24 along surfaces 40 and 42. The second end ring 28 is sealingly bonded to second end 32 along surfaces 44 and 46.

Figure 3:
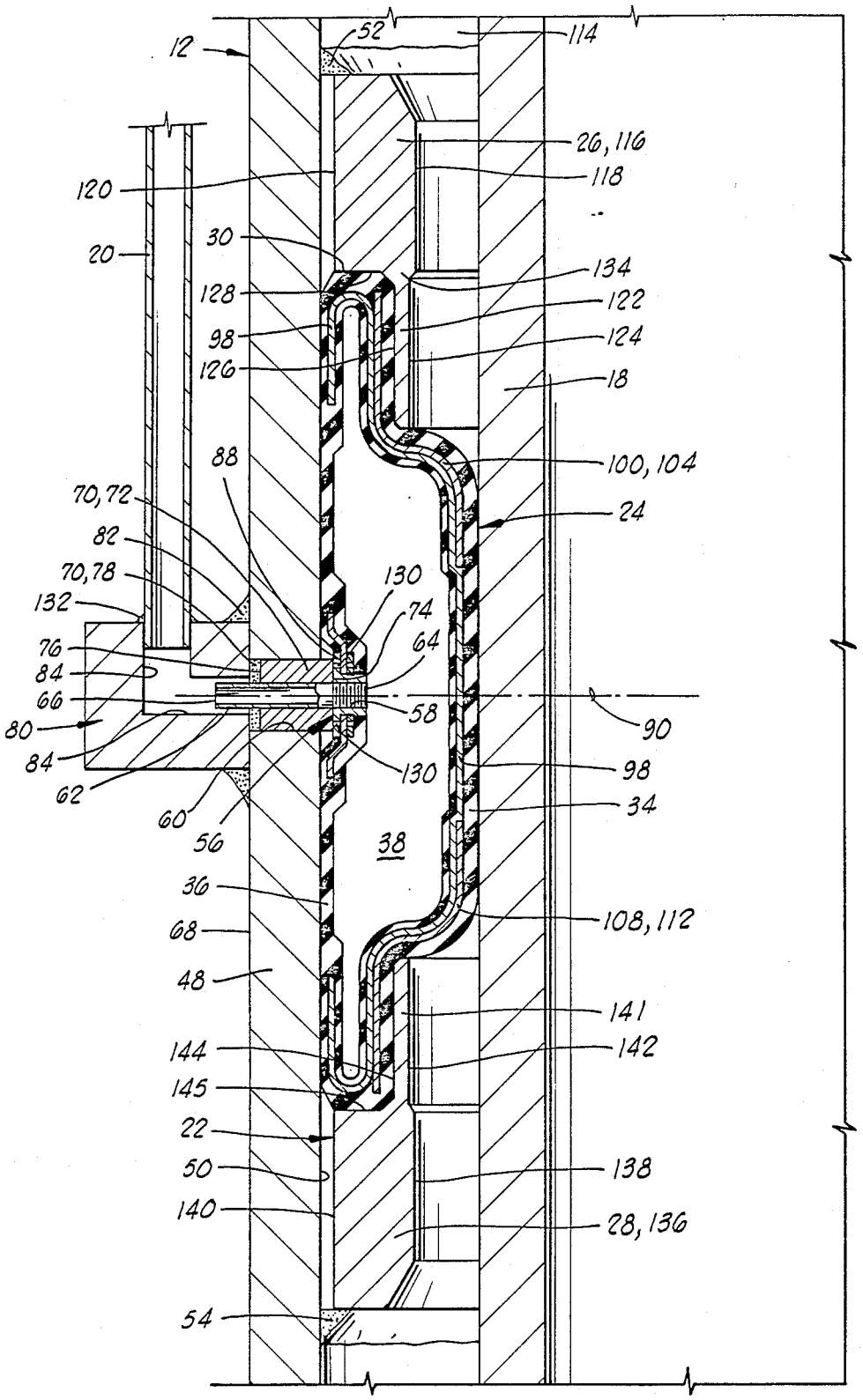
FIG. 3 is an elevation sectioned view showing the bladder assembly of FIG. 2 in place within an outer housing, i.e., the jacket leg of an offshore platform, and inflated to seal the annulus between the housing and a piling received therethrough.

As seen in FIG. 3, the packer 12 also includes a housing 48 having a cylindrical inner bore 50. The housing 48 will typically be a cylindrical member of the same dimensions as the remaining portion of the pile sleeve 14 and will be welded in place as an integral part of the pile sleeve 14.

The inflatable bladder assembly 22 is received within the inner bore 50 of housing 48, and the first and second end rings 26 and 28 are sealingly attached to housing 48 such as by annular welds 52 and 54 so that a backup seal is thereby provided against leakage of inflation fluid through the radially outer wall 36 of the inflatable bladder means 24.

The inflatable bladder means 24 can then be inflated and thus provides a means for sealing between the housing 48 and the pile 18 which may be generally referred to as an elongated cylindrical member 18 received through the bladder means 24.

Figure 4:
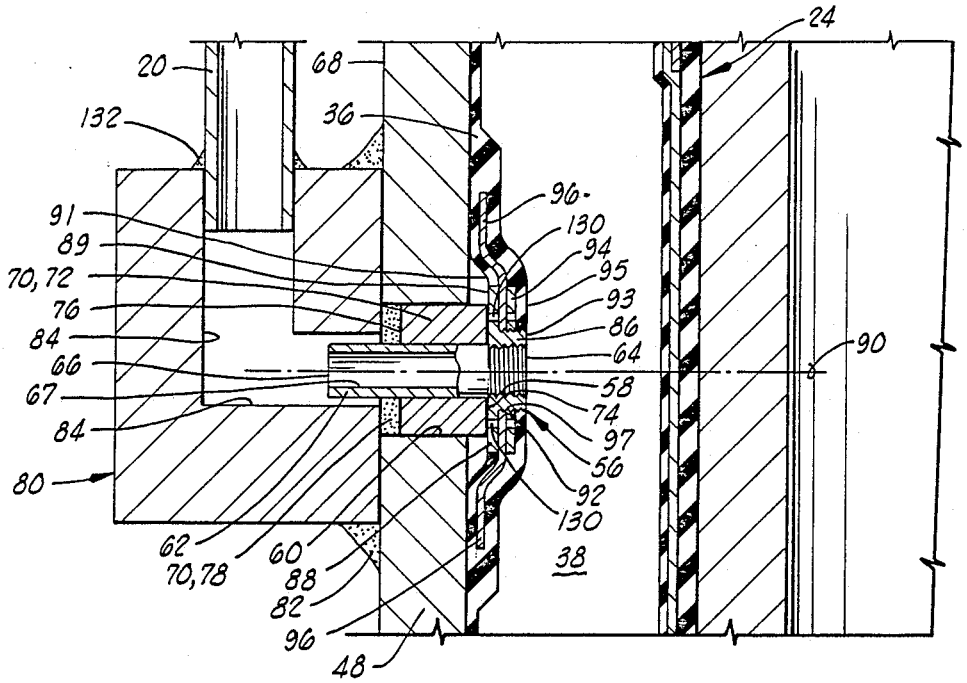
FIG. 4 is an enlarged view of the inflation coupling and surrounding portions of the packer of FIG. 3.

The bladder means 24 includes an inflation coupling means 56 molded into the radially outer wall 36 and having a bore 58 defined therethrough which may also be referred to as a bladder inflation inlet 58. The details of inflation coupling means 56 are best seen in the enlarged view of FIG. 4.

The housing 48 has a transverse access opening 60 defined therethrough which is aligned with the inflation inlet 58. An inflation nipple 62 has a radially inner end 64 which is threadedly and sealingly engaged with the threaded bore or bladder inflation inlet 58 of the inflation coupling means 56. The inflation nipple 62 includes a radially outer end 66 extending outward through the access opening 60 of housing 48. The outer end 66 of inflation nipple 62 is an open outer end 66 and extends outward beyond a cylindrical outer surface 68 of housing 48. Nipple 62 includes a nipple bore 67 communicated with inflation cavity 38.

An attachment means 70 is provided for sealingly attaching the inflation nipple 62 to the housing 48. The attachment means 70 includes an annular filler sleeve 72 received concentrically about the inflation nipple 62 and within the access opening 60 of housing 48. The filler sleeve 72 has an inner end 74 abutting an outer surface 89 of the inflation coupling means 56, and has an outer end 76 welded all around as indicated at 78 to the housing 48 and the inflation nipple 62.

An inflation block 80 is attached to the housing by weld 82 and has a right angle shaped inflation passage 84 defined therethrough. The outer end 66 of the inflation nipple 62 is received in the inflation passage 84.

The inflation line 20 is connected to the inflation block 80 for supplying inflation fluid through passage 84 to the inflatable bladder means 24.

The inflation coupling means 56 includes a cylindrical coupling body 86 having the inflation bore or bladder inflation inlet 58 defined therethrough. Coupling body 86 includes a first annular flange 88 extending outward therefrom in a plane substantially normal to a central axis 90 of the coupling body 86. Coupling body 86 also includes a threaded cylindrical outer surface 92.

The flange 88 of inflation coupling means 56 is partially imbedded in the radially outer wall 36 so that a radially outer surface 89 of flange 88 is flush with a radially outer surface 91 of radially outer wall 36 of inflatable bladder means 24. A radially inner end 93 of coupling body 86 is substantially flush with a radially inner surface 95 of radially outer wall 36.

The inflation coupling means 56 also includes a threaded nut 94 threadedly engaged with the threaded outer cylindrical surface 92 of the coupling body 86. The nut 94 can also be referred to as a second flange extending outward from the body 86.

The inflation coupling means 56 further includes a reinforcing fabric 96 having an opening 97 therein through which the coupling body 86 is received. The reinforcing fabric 96 is tightly sandwiched between the flange 88 and the threaded nut 94. The reinforcing fabric 96 is imbedded in the elastomeric material making up the radially outer wall 36 of the bladder means 24. Fabric 96 may be a woven polyester fabric.

Referring now to FIGS. 2 and 3, the inflatable bladder means 24 includes a layer of fabric reinforcement 98 imbedded in and extending along the length of the radially inner wall 34, and having turned back portions extending around the ends of the inflation cavity 38 and then axially inward along a portion of the length of the radially outer wall 36.

A first annular backup shoe means 100, preferably constructed of steel wire or other similar stiffening material, is imbedded in and molded into the radially inner wall 34 of bladder means 24. First annular backup shoe means 100 has an axially outer portion 102 located radially outward of at least a part 122 of the first end ring 26. First annular backup shoe means 100 includes an axially inner portion 104 extending beyond an inner end 106 of the first end ring 26 toward the second end ring 28.

A second annular backup shoe means 108 is similarly constructed and associated with the second end ring 28. It includes an axially outer portion 110 located radially outward of at least a part of second end ring 28, and has an axially inner portion 112 extending beyond an end 114 of the second end ring 28 toward the first end ring 26.

As seen in FIG. 3, when the inflatable bladder means 24 is inflated, the axially inner portions 104 and 112 of first and second annular backup shoe means 100 and 108, respectively, provide a means for deforming radially inward with the radially inner wall 34 which tightly engages the pile 18 extending therethrough. An annulus 114 defined between the outer housing 48 and the pile 18 between two spaced annular packers 12, such as seen in FIG. 1, will then be filled with a grout material (not shown). As will be appreciated by those skilled in the art, the annular column of grout material creates an extreme hydrostatic head particularly upon the lower grout packer. The first and second backup shoe means 100 and 108 provide a means for supporting the bladder means 24 against the axial loads created by the column of grout after inflation of the bladder means 24.

The first end ring 26 has an axially outer ring portion 116 having an inside diameter 118 and an outside diameter 120. First end ring 26 also includes an axially inner ring portion 122 having an increased diameter inner surface or inside diameter 124, and having a reduced diameter outer surface or outside diameter 126. The end ring 26 may be constructed by manufacturing the axially outer portion 116 and the axially inner portion 122 from separate pieces of cylindrical steel stock which are then butted together and welded at the location generally designated as 134.

The radially inner wall 34 of inflatable bladder means 24 is bonded to the outside diameter 126 of axially inner ring portion 122. First end 30 of bladder means 24 is bonded to a shoulder 128 joining the outside diameter 120 of axially outer ring portion 116 and the outside diameter 126 of axially inner ring portion 122.

Second ring 28 is similarly constructed and has an axially outer ring portion 136 with inside diameter 138 and outside diameter 140, and an axially inner ring portion 141 with increased inside diameter 142 and reduced outside diameter 144. Bladder means 24 is bonded to reduced outside diameter 144 and to shoulder surface 145.

Manner Of Installation And Operation Of The Packer

The inflatable bladder assembly 22 can be provided to the customer in the form shown in FIG. 2. The bladder assembly shown in FIG. 2 can be tested prior to delivery to the customer simply by clamping the bladder assembly in place within a cylindrical test shell of the same inside dimension as housing 48, and connecting an inflation line to the bladder inflation inlet 58 and inflating the bladder means 24 to test the same for leaks.

The inflatable bladder assembly 22 is delivered to the site where the platform 10 is being constructed along with an inflation nipple 62 and a filler sleeve 72.

The housing 48 will be located in the pile sleeve 14 at the desired position, and a transverse access opening 60 will be formed in the housing 48.

Then, the inflatable bladder assembly 22, in an uninflated state, is slipped into the inner bore 50 of housing 48 and the inflation inlet bore 58 is aligned with the access opening 60. The end rings 26 and 28 will initially be tack-welded in place.

A tool such as a spanner wrench (not shown) is then inserted through the access opening 60 to engage spanner wrench holes 130 in the flange 88. The spanner wrench is used to hold the inflation coupling means 56, and particularly the flange 88 against rotation about its axis 90. The openings 130 may also be referred to as engagement means 130 accessible through the access opening 60 for holding the inflation coupling 56 while the inflation nipple 62 is being threaded into the inflation inlet bore 58.

Then, while holding the coupling means 56 with the spanner wrench, the inflation nipple 62 is inserted through the access opening 60 and threaded into engagement with the threaded bore or bladder inflation inlet 58.

Then, the spanner wrench is removed from the access opening 60, and the filler sleeve 72 is inserted into the access opening 60 so that it is concentrically received about the inflation nipple 62. The radially inner end 74 of filler sleeve 62 is butted up against the radially outer surface 89 of flange 88. Then, the weld 78 is made all around the radially outer end 76 of filler sleeve 72 to seal between the filler sleeve 72 and housing 48 and between the filler sleeve 72 and threaded nipple 62.

Then, the inflation block 80 is placed over the outer end 66 of threaded nipple 62, and weld 82 is made to connect the inflation block 80 to the housing 48. The inflation line 20 is connected to inflation block 80 such as by weld 132. A check valve (not shown) may be disposed in the inflation line 20 or built into the inflation block 80.

Then, the complete end welds 52 and 54 are made to sealingly connect the end rings 26 and 28 to the inner bore 50 of housing 48.

This structure provides both a primary seal and a backup seal for the inflation fluid contained in the inflatable bladder means 24. The primary seal is provided by the construction of the radially inner and outer walls 34 and 36 of the inflatable bladder means 24. The inflation fluid is primarily sealed within the inflation cavity 38. In the event, however, that the inflation fluids were to leak through the radially outer wall 36, and particularly if a leak forms around the inflation coupling means 56 disposed in the radially outer wall 36, any fluid that so leaks is still contained within a backup seal provided by welds 52 and 54 and by the bond between the inflatable bladder means 24 and the end rings 26 and 28. The maintenance of the inflation pressure within the packer is not dependent upon the end ring welds 52 and 54 as it is in the design of the Sullaway et al. U.S. Pat. No. 4,337,010.

Subsequently, after the platform 10 is transported to the appropriate location above the ocean floor and set in place on the ocean floor, the piles 18 will be driven through the pile sleeves 14 into the ocean floor as schematically represented in FIG. 1. Then, inflation fluid is pumped through the inflation lines 20 to inflate the inflatable bladder means 24 as seen in FIG. 3. Subsequently, the annular space 114 between the upper and lower packers 12 is filled with grout which hardens to structurally join the jacket sleeves 14, including the outer housings 48, with the pile 18. The bladder means 24 remains inflated at least until the grout has hardened. The backup shoes 100 and 108 prevent the elastomeric material of inner wall 34 from extruding between end ring 28 and pile 18 due to the pressure exerted by the column of grout in annulus 114.

Figure 5:
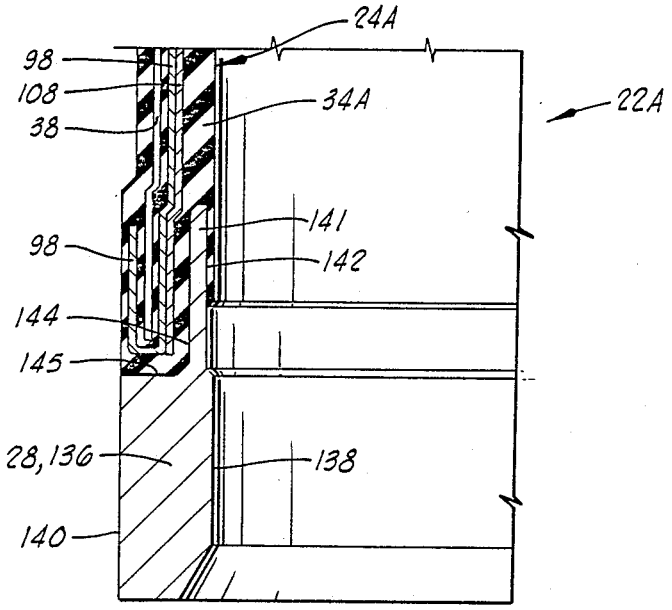
FIG. 5 is a elevation sectioned partial view of an alternative embodiment of the bladder assembly.

Alternative Embodiment Of FIG. 5

FIG. 5 shows a modified bladder assembly 22A in which the radially inner wall 34A of inflatable bladder means 24A has been made somewhat thicker than the radially inner wall 34 of FIG. 2 and extends over and is bonded to at least a portion of the increased diameter inner surfaces 124 and 142 of end rings 26 and 28.

This additional bonded surface of the radially inner wall 34A to the end rings 26 and 28 provided by the embodiment of FIG. 5 increases the reliability of the backup seal arrangement previously discussed in that it provides more bonded surface between the inflatable bladder means 24 and the end rings 26 and 28. The very high hydraulic pressures which are present within the annulus 114 are kept away from the steel-to-rubber bond along surfaces 144 and 145.

Figure 6:
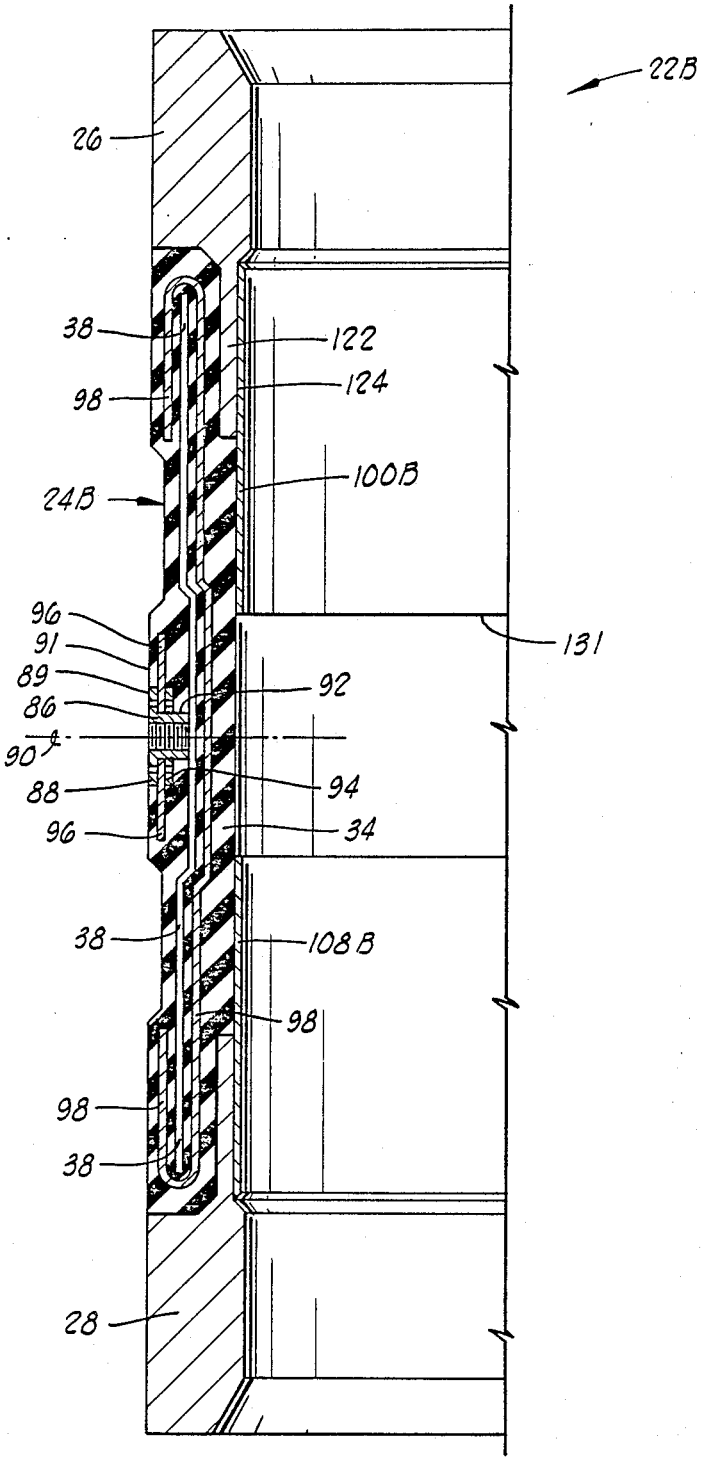
FIG. 6 is an elevation sectioned view of another alternative embodiment of the bladder assembly.

Alternative Embodiment Of FIG. 6

Another alternative embodiment of the present invention is shown in FIG. 6. A modified inflatable bladder assembly is shown and generally designated by the numeral 22B.

The inflatable bladder means 24B has been modified in that the imbedded first and second backup shoe means 100 and 108 have been deleted, and replaced by first and second annular backup shoe means 100 and 108B which are attached directly to the end rings 26 and 28. The first annular backup shoe means 100B is attached to the inner bore 124 of axially inner ring portion 122 such as by welding. The first annular backup shoe means 100 has an axially inner end 131 extending from the first end ring 26 and closely and concentrically received within the radially inner wall 34 of inflatable bladder means 24B. Second annular backup shoe means 108B is similarly constructed.

The backup shoes 100B and 108B may each be formed from an annular ring having longitudinal slots cut therein and open to the axially inner end of the ring so as to increase the flexibility of the axially inner portion of the ring which will deform upon inflation of the packer.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. An inflatable packer apparatus, comprising:

a housing having an inner bore;

an annular inflatable bladder means, received in said inner bore of said housing, said bladder means having an inflation cavity defined therein for containing an inflation fluid, said bladder means having first and second axial ends and having radially inner and outer walls, said bladder means providing a means for sealing between said housing and an elongated cylindrical member received through said bladder means; and first and second end rings sealingly bonded to said first and second ends of said bladder means and also sealingly attached to said housing so that a backup seal is thereby provided against leakage of said inflation fluid through said radially outer wall of said bladder means.

2. The apparatus of claim 1, wherein:

said radially outer wall of said bladder means has a bladder inflation inlet defined therethrough.

3. The apparatus of claim 2, wherein:

said bladder means includes an inflation coupling means, attached to said radially outer wall and having a bore therethrough defining said inflation inlet.

4. The apparatus of claim 3, wherein:

said housing has a transverse access opening defined therethrough and aligned with said inflation inlet; and said apparatus further includes an inflation nipple sealingly engaged with said bore of said inflation coupling means, and extending outward through said access opening of said housing.

5. The apparatus of claim 4, wherein:

said inflation nipple is threadedly connected to said bore of said inflation coupling.

6. The apparatus of claim 4, wherein:

said inflation nipple has an open outer end extending outward beyond an outer surface of said housing; and said apparatus further includes attachment means for sealingly attaching said inflation nipple to said housing.

7. The apparatus of claim 6, further comprising:

an inflation block attached to said housing and having an inflation passage defined therethrough, said outer end of said inflation nipple being received in said inflation passage.

8. The apparatus of claim 6, further comprising:

said attachment means which includes a filler sleeve received about said inflation nipple and within said access opening of said housing, said filler sleeve having an inner end abutting said inflation coupling means, said filler sleeve having an outer end welded all around to said housing and to said inflation nipple.

9. The apparatus of claim 3, wherein said inflation coupling comprises:

a cylindrical coupling body having said bore defined therethrough, having an annular flange extending outward from said body in a plane substantially normal to a central axis of said coupling body, and having a threaded outer cylindrical surface;

a threaded nut threadedly engaged with said threaded outer cylindrical surface of said coupling body; and a reinforcing fabric having an opening therein through which said coupling body is received, said reinforcing fabric being sandwiched between and engaging said flange and said nut; and said reinforcing fabric being embedded in said radially outer wall of said bladder means.

10. The apparatus of claim 1, further comprising:

first annular backup shoe means embedded in said radially inner wall of said bladder means, said first annular backup shoe means having an axially outer portion located radially outward of at least a part of said first end ring and having an axially inner portion extending beyond said first end ring toward said second end ring;

second annular backup shoe means, embedded in said radially inner wall of said bladder means, said second annular backup shoe means having an axially outer portion located radially outward of at least a part of said second end ring and having an axially inner portion extending beyond said second end ring toward said first end ring; and wherein said axially inner portions of said first and second annular backup shoe means are further characterized as means for deforming radially inward with said radially inner wall upon inflation of said bladder means and for supporting said bladder means against axial loads after inflation of said bladder means.

11. The apparatus of claim 10, wherein:

said first end ring has an axially outer ring portion having an inside diameter and an outside diameter, and said first end ring has an axially inner ring portion having an increased diameter inner surface and a reduced diameter outer surface compared to said axially outer ring portion of said first end ring; and said radially inner wall of said bladder means is constructed of an elastomeric material bonded to said reduced diameter outer surface and to at least a portion of said increased diameter inner surface.

12. The apparatus of claim 1, further comprising:

first annular backup shoe means attached to said first end ring and having an axially inner end extending therefrom and closely and concentrically received within said radially inner wall of said bladder means; and second annular backup shoe means attached to said second end ring and having an axially inner end extending therefrom and closely and concentrically received within said radially inner wall of said bladder means.

13. An inflatable packer apparatus, comprising:

an annular inflatable bladder means having an inflation cavity defined therein for containing an inflation fluid, said bladder means having first and second axial ends and having radially inner and outer walls; and an inflation coupling attached to said radially outer wall and having an inflation inlet bore defined therethrough communicating with said inflation cavity, said inflation coupling including:

a cylindrical coupling body having said bore defined therethrough;

first and second spaced flanges extending outward from said body in planes substantially normal to a central axis of said coupling body;

a reinforcing fabric having an opening therein through which said coupling body is received, said reinforcing fabric being tightly sandwiched between and engaging said flanges;

said reinforcing fabric being embedded in said radially outer wall of said bladder means.

14. The apparatus of claim 13, wherein:

said first flange is formed integrally with said coupling body, and said coupling body has a threaded outer cylindrical surface; and said second flange is a threaded nut threadedly engaged with said threaded outer cylindrical surface of said coupling body.

15. The apparatus of claim 13, wherein:

said first flange is partially embedded in said radially outer wall so that a radially outer surface of first flange is flush with a radially outer surface of said radially outer wall; and a radially inner end of said coupling body is substantially flush with a radially inner surface of said radially outer wall.

16. The apparatus of claim 13, further comprising:

first and second end rings sealingly bonded to said first and second ends of said bladder means;

a housing having an inner bore, said first and second end rings and said bladder means being received in said inner bore of said housing with said first and second end rings attached to said housing, said housing having a radial access opening defined therethrough and aligned with said inflation inlet bore of said inflation coupling;

an inflation inlet nipple having a radially inner end connected to said inflation coupling, said nipple having a nipple bore communicated with said inflation cavity; and a filler sleeve received about said inflation nipple and within said access opening of said housing, said filler sleeve being sealingly welded to said housing and to said inflation nipple to completely seal said access opening between said housing and said inflation nipple.

17. The apparatus of claim 16, wherein:

said inflation nipple is threadedly connected to said inflation inlet bore of said inflation coupling; and said inflation coupling includes engagement means accessible through said access opening, for holding said inflation coupling while said inflation nipple is being threaded into said inflation inlet bore.

18. A method of assembling an inflatable packer apparatus, said method comprising:

(a) providing a cylindrical housing having a central bore defined axially therethrough and having an access opening defined transversely therethrough and communicated with said central bore;

(b) providing an inflatable bladder assembly including an inflatable bladder with first and second axial end rings attached thereto, said inflatable bladder having radially inner and outer walls defining an inflation cavity therebetween, and said radially outer wall having an inflation coupling mounted therein with an inflation inlet bore defined through said inflation coupling and communicated with said inflation cavity;

(c) inserting said inflatable bladder assembly into said central bore of said housing;

(d) aligning said inflation inlet bore of said inflatable bladder assembly with said access opening of said housing;

(e) inserting a tool through said access opening and engaging said inflation coupling, and thereby holding said inflation coupling against rotation about an axis of said inflation inlet bore; and (f) during step (e), inserting an inflation nipple through said access opening of said housing and threadedly connecting said inflation nipple with said inflation inlet bore.

19. The method of claim 18, further comprising:

(g) after step (f), removing said tool and inserting a filler sleeve into said access opening so that said filler sleeve is concentrically received about said inflation nipple.

20. The method of claim 19, further comprising:

(h) after step (g), welding said filler sleeve to said housing and to said inflation nipple to completely seal said access opening between said housing and said inflation nipple.

* * * * *